United States Patent [19]

Raith et al.

[11] 4,251,968

[45] Feb. 24, 1981

[54] DEMOUNTABLE INTERIOR PARTITION SYSTEM, COMPONENTS THEREFOR, AND METHOD OF MAKING SUCH COMPONENTS

[75] Inventors: Richard L. Raith, Solon, Ohio; Joseph A. Davenport, Portland, Oreg.

[73] Assignee: Hauserman, Inc., Cleveland, Ohio

[21] Appl. No.: 882,668

[22] Filed: Mar. 2, 1978

[51] Int. Cl.[3] ..... E04C 1/10

[52] U.S. Cl. ..... 52/584; 52/586; 52/471; 52/802

[58] Field of Search ..... 52/584, 586, 588, 468, 52/470, 471, 805, 804, 802

[56] References Cited

U.S. PATENT DOCUMENTS

| | | | |
|---|---|---|---|
| 2,822,898 | 2/1958 | Richards | 52/468 X |
| 3,172,237 | 3/1965 | Bradley | 52/396 X |
| 3,320,706 | 5/1967 | Elliott et al. | 52/471 X |
| 3,363,383 | 1/1968 | La Barge | 52/584 X |
| 3,594,028 | 7/1971 | Scott | 52/471 X |
| 3,886,698 | 6/1975 | Raith et al. | 52/36 |

FOREIGN PATENT DOCUMENTS 1400613 7/1975 United Kingdom .

*Primary Examiner*—Carl D. Friedman
*Attorney, Agent, or Firm*—Maky, Renner, Otto & Boisselle

[57] ABSTRACT

An interior partition system wherein with relatively few components, most of which can be roll formed from common sets of roller dies, a wide variety of interior screens or full height partitions can be constructed, thus avoiding the necessity of the manufacture and inventory of a large number of parts. For some parts, where volume may not justify the investment in the required roll sets, other manufacturing techniques may be employed, but such parts are readily compatible with the high volume components and usable interchangeably therewith. In the preferred form, a verticaless panel is constructed having a roll formed slotted, recessed edge which includes a double thickness folded flange of special configuration so that adjacent panels may readily be secured together either with a multipurpose co-extruded plastic zipper strip which will provide the desired light and sound seal, accommodate a wide variety of surface finishes and provide an appearance cover for the recessed slots yet providing access thereto for hanging components or accessories to the screen or partition, or a spring metal panel connector.

43 Claims, 30 Drawing Figures

DEMOUNTABLE INTERIOR PARTITION SYSTEM, COMPONENTS THEREFOR, AND METHOD OF MAKING SUCH COMPONENTS

BACKGROUND OF THE INVENTION

This invention relates to a demountable interior partition system, components therefor, a method of making such components, and more particularly to a unified partition system wherein readily manufactured, modular structural components may be easily assembled and disassembled with various head and base assemblies to create a variety of different screen or partition systems, and still more particularly to such a partition system with accessory supporting capabilities.

Traditionally, partition systems have been designed at various times to meet specific requirements and performance levels, which over the years has culminated in a multitude of different generally incompatible structural components and different kinds of hardware. For example, screen assemblies have been commonly designed with different requirements in mind than full height partitions, and therefore, have required different manufacturing procedures as well as their own supporting hardware. Even though the structural components are of similar construction, each often has its own configuration and is mounted in a different manner using its own variety of clips, posts, verticals and the like, notwithstanding that the function of a given part may be identical to that of another part.

As mentioned generally above, assembly of several structural components, such as panels, into a composite partition wall in accordance with prior art practice requires auxiliary panel interconnecting components such as verticals or posts as the panels are normally fabricated to be placed in edge abutting relationship. Such auxiliary components may be provided with vertically-spaced mounting slots from which accessories are hung. One of the more common auxiliary components for such panels is a U-shaped vertical that is received into channels at opposite vertical edge portions of the panels. The verticals of adjacent edge portions are secured together such as by fasteners to form a rigidly secured assembly. Providing and installing of these U-shaped verticals, however, adds considerably to the expense of the partition wall system.

An example of a partition screen assembly having similar accessory support capabilities may be seen in applicant's assignee's U.S. Pat. No. 3,886,698, dated June 3, 1975. In such partition assembly, panels are provided at their vertical mounting edges with reinforced flanges which in turn are provided with vertically-spaced mounting slots from which the accessories are hung. Heretofore, the reinforced flanges required forming by expensive press-brake bending or when separate verticals are employed by extrusion techniques to assure the required strength and alignment of the slots provided in the reinforced flanges, rather than roll-forming techniques where tolerances are less exacting but production capabilities greatly increased.

Another drawback in previous assemblies of the type described is that the number of interfitting parts makes it a difficult and time-consuming job first to assemble and then install or reinstall the partitions. Moreover, the use of fastening members or certain types of panel connecting keys present time-consuming assembly and disassembly problems, most of which require the removal of panels or post caps for access. The removal and replacement of such parts can wear the surface finish, particularly when a tool such as a screwdriver is employed. Examples of such verticals and key connected partition systems may be seen in Bohnsack U.S. Pat. Nos. 3,120,031 or 3,180,457.

SUMMARY OF THE INVENTION

This invention provides a unified modular partition system comprises of a family of design and functionally compatible, structural components which are simple in construction, few in number, and which may be readily assembled into a variety of screen or full height partition systems.

The panel system of the invention is characterized by a demountable panel construction formed of spaced-apart face plates. Each face plate is bent inwardly at its vertical edge and then upon itself to form double thickness, vertically extending, recessed J-shaped flange and terminates in outturned connecting edges by which reversely positioned face plates are interconnected. Fasteners hold together the juxtaposed connecting edges to secure adjacent face plates together. With such an arrangement, partition panels having reinforced mounting panel edges may be employed in either partition wall or screen assemblies. The various other modular structural components of the invention include at least one such mounting panel edge of similar shape for interconnection of the same at such mounting edges to provide any variety of partition layouts.

The recessed J-shaped flanges of the panel face plates as above described have a plurality of vertically-spaced mounting slots provided in the folded recessed flanges from which accessories may be hung. According to the method of the invention, such face plates are made first by forming a double parallel row of slots in the edges of planar sheet metal blanks with the slots of one row larger than those in the other. The edge is then roll-formed into a double-thickness flange such that the smaller slots of one row are aligned with any portion of the larger slots of the other row. Accurate and precise alignment of the slots is then no longer required.

According to another embodiment of the invention, an integrated demountable panel construction comprises spaced-apart face plates, each having inturned vertical edge flanges which terminate in outturned connecting edges by which opposite face plates are interconnected. Separate vertical elements include central channels enclosing the outturned connecting edges to secure the face plates together. The vertical elements further have edge flanges which form J-shape projections extending from each inturned vertical flange of the face plates, and may be provided with vertically spaced mounting slots from which accessories may be hung. With such integrated construction, the bent edges and separate vertical elements combine to define reinforcing mounting panel edges of similar shape and compatible with the mounting panel edges of the aforenoted demountable panel construction. Accordingly, panels of either construction may be used interchangeably in the partition system.

The demountable panel construction of the invention is further characterized by the recessed J-shape flanges of the panel edges which may be juxtaposed and secured together by an elongated plastic connector strip. The connector strip has a central U-shaped body or bight portion adapted to embrace and hold together the juxtaposed J-shape flanges. The connector strip further has at least one flexible wing extending laterally of the central body portion into close proximity or sealing engagement with the inturned edge flange of the panels to conceal, yet allow access to, the mounting slots for the hanging of accessories thereform. The connector strip may be a plastic coextrusion with the plastic of the wings being more flexible than the plastic of the central body portion.

It is accordingly a principal object of this invention to provide a unified partition system comprised of relatively few and easily constructed modular structural components which are design and functionally compatible and may be easily assembled and disassembled in any of a variety of partition systems.

It is another principal object of the invention to provide an improved demountable panel construction having integral, strengthened mounting edges that may be used in either wall or in screen assemblies with or without supporting structural posts.

It is still another principal object of the invention to provide a demountable panel construction including an elongate plastic connector strip for quickly and easily fastening the mounting edges of adjacent structural components together.

It is yet another object of the invention to eliminate to a significant extend the use of high cost metal extrusions or press formed components.

It is a further object of the invention to provide a partition system that may be manufactured by a single inexpensive system in areas having a low skill working force.

It is still a further object of the invention to facilitate the assembly and disassembly of partition panel assemblies.

A further important object is the provision of a partition system where the panels or components may be held together solely by a multi-purpose plastic strip.

It is also an important object to provide such strip fastening system which is completely accessible from the exterior of the panel not requiring the removal of parts for access to connectors.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

Figure 1:
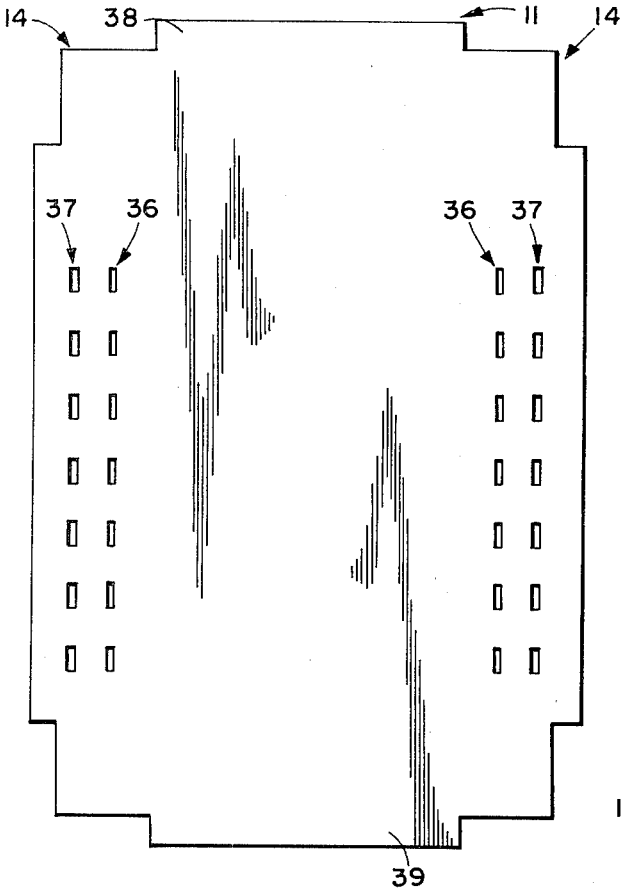
FIGS. 1–4 disclose a preferred panel face plate in accordance with the invention and its method of fabrication.
Figure 2:
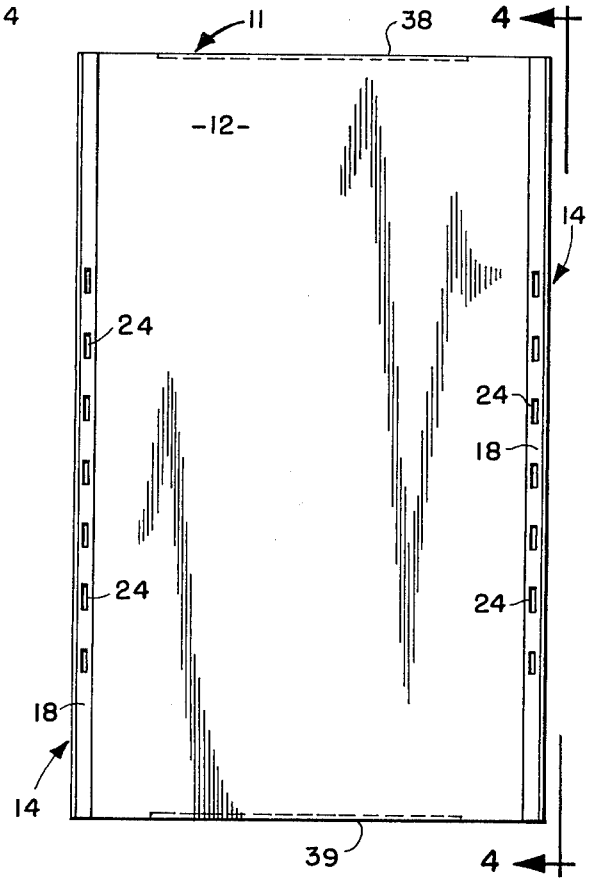
Figure 4:
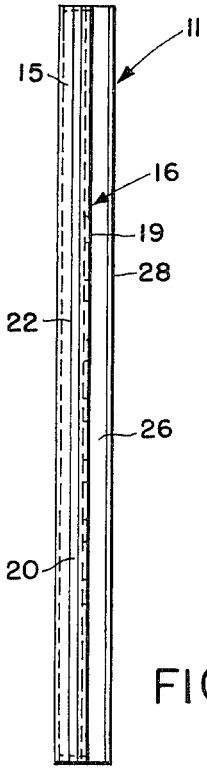
Figure 3:
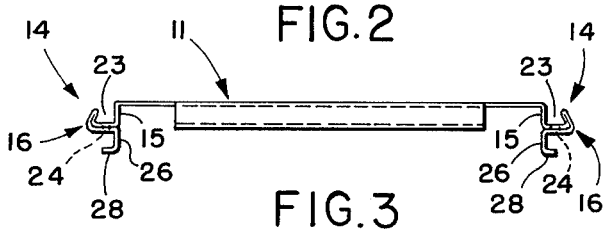
Figure 5:
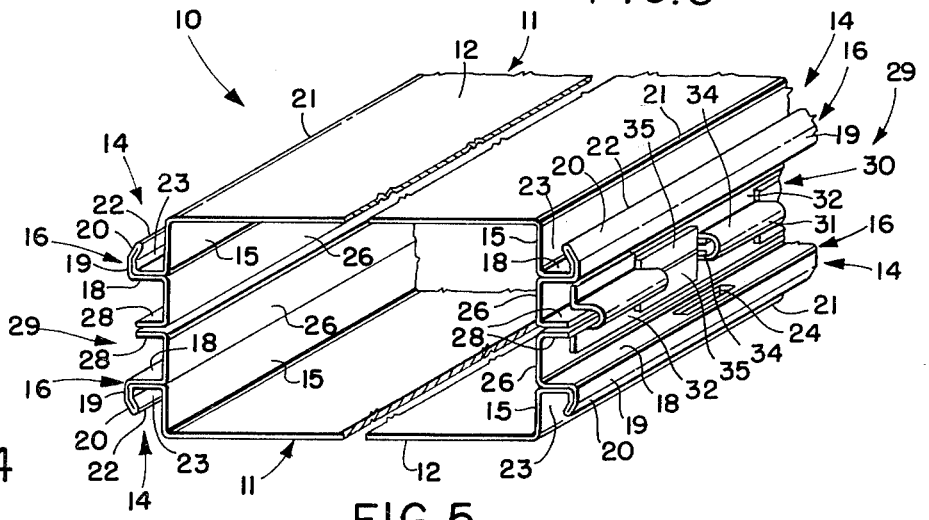
FIG. 5 discloses two such face plates assembled back-to-back to form a screen or wall panel mono-element.
Figure 6:
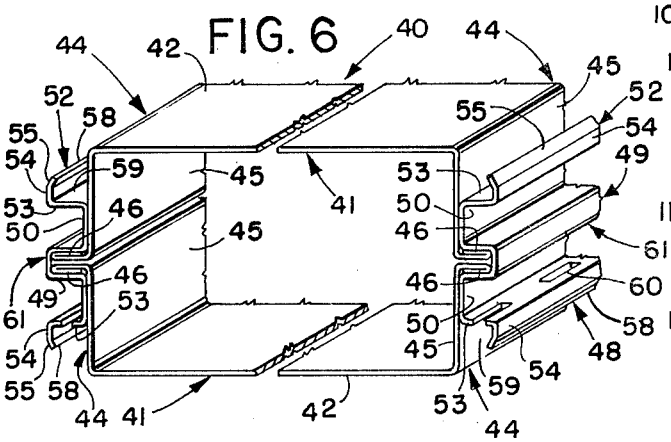
FIG. 6 discloses an alternative form of panel in accordance with the present invention.
Figure 8:
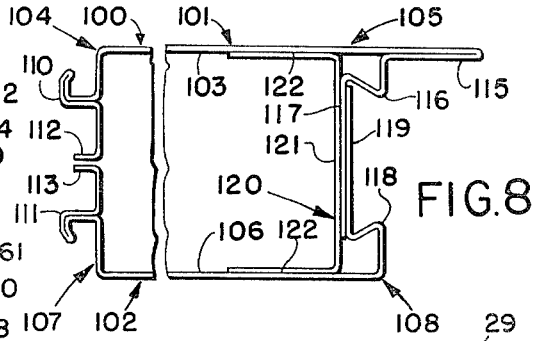
FIGS. 7–11 disclose various other modular structural components and their constructions which make up a family of modular components in accordance with the invention.
Figure 7:
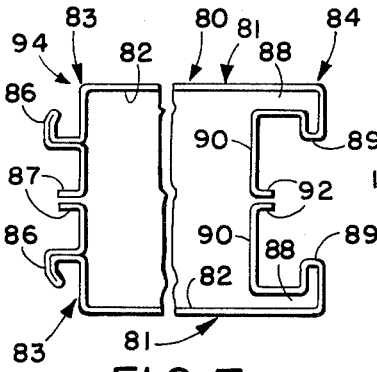
Figure 9:
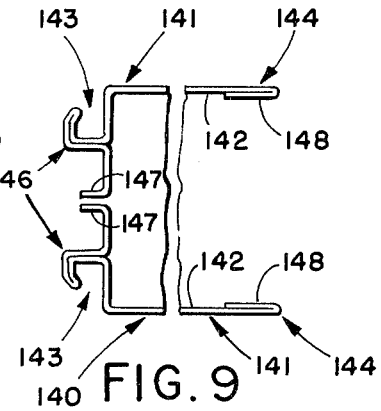
Figure 12:
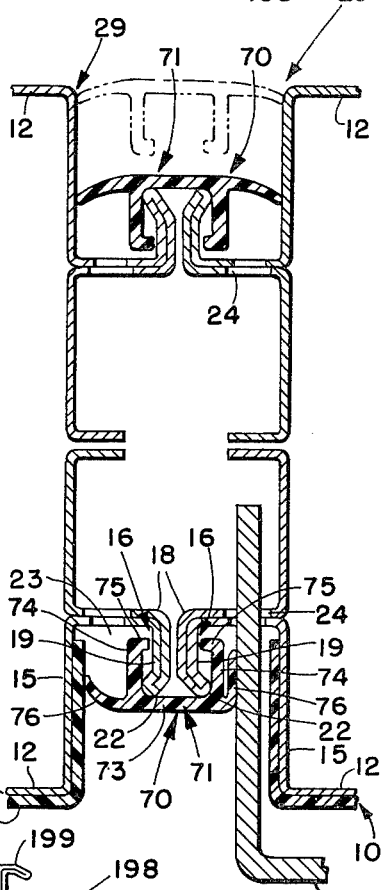
FIG. 12 is an enlarged horizontal section showing a preferred panel connector strip in accordance with the invention by which adjacent structural components may be interconnected.
Figure 10:
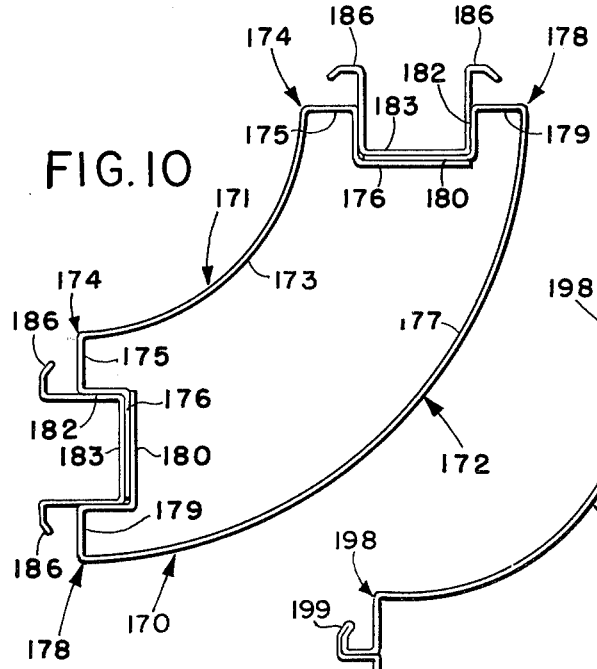
Figure 11:
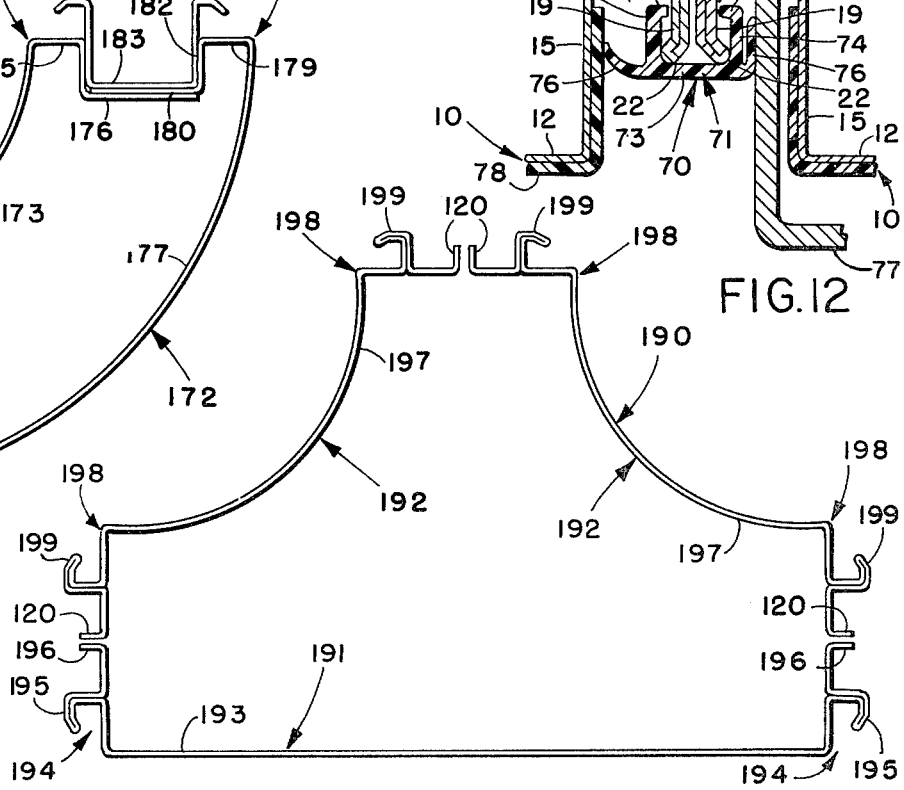
Figure 13:
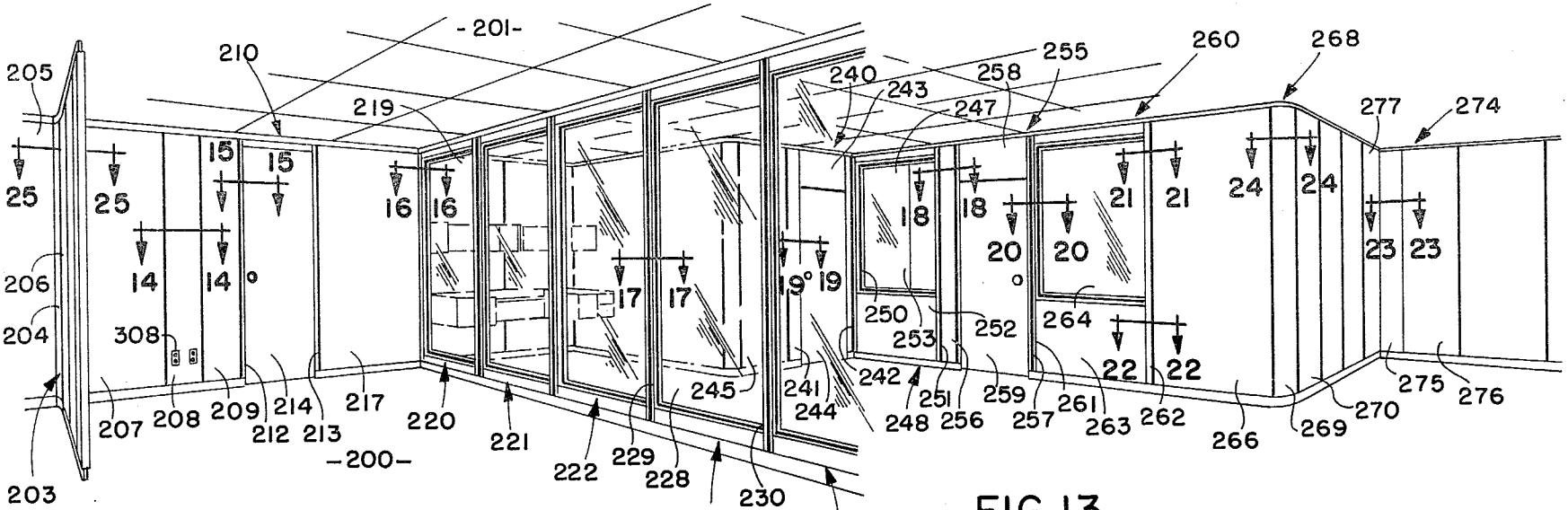
FIG. 13 is a perspective elevation and in FIGS. 14–25 various horizontal sections relating to a particular full height partition assembly showing exemplary intersections between the various modular components in accordance with the invention.
Figure 15:
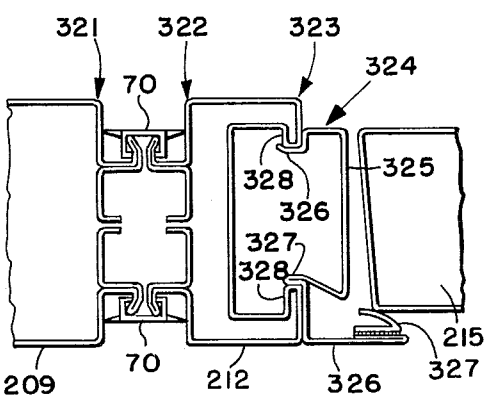
Figure 14:
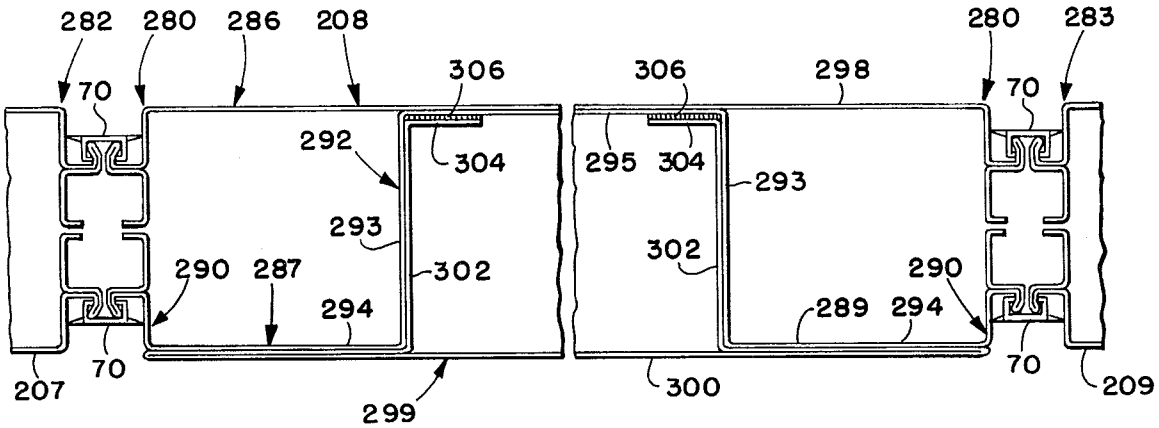
Figure 16:
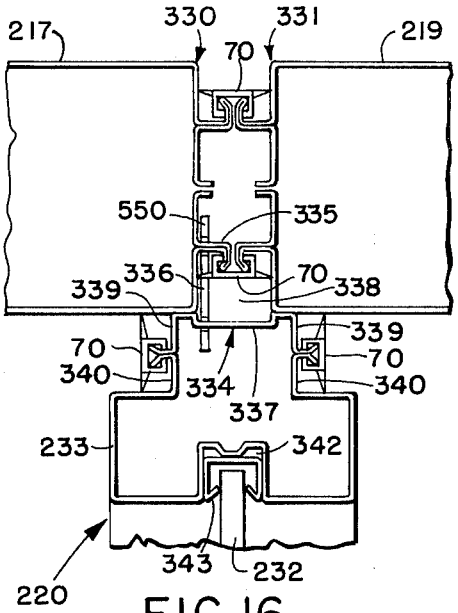
Figure 17:
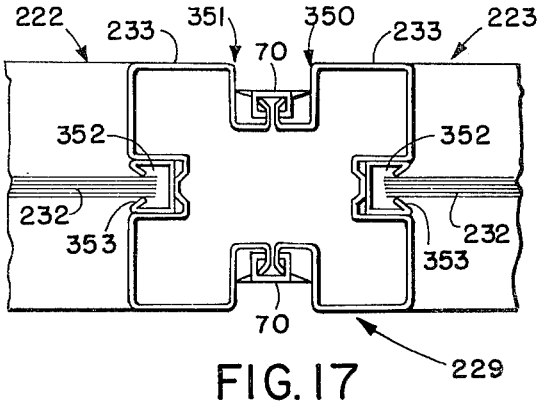
Figure 18:
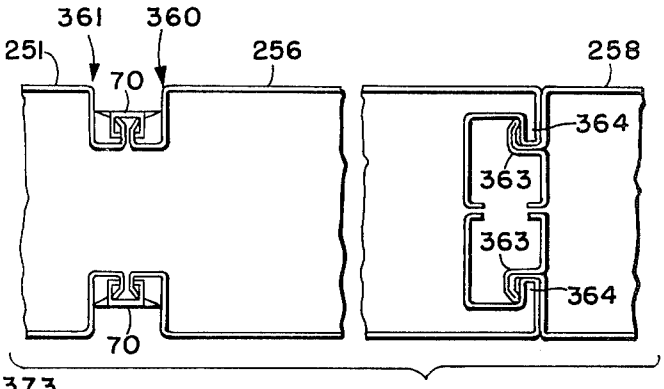
Figure 19:
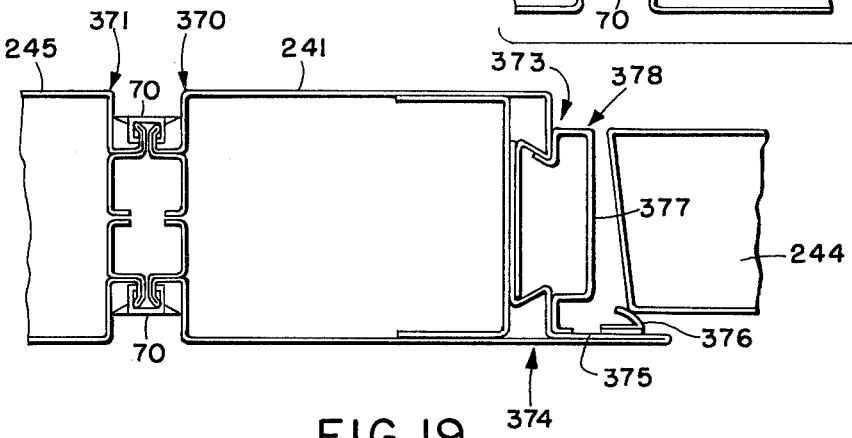
Figure 20:
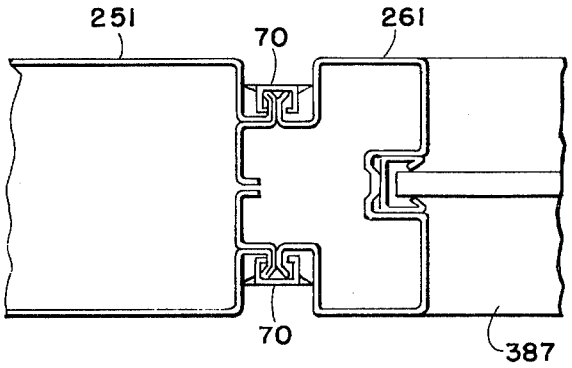
Figure 21:
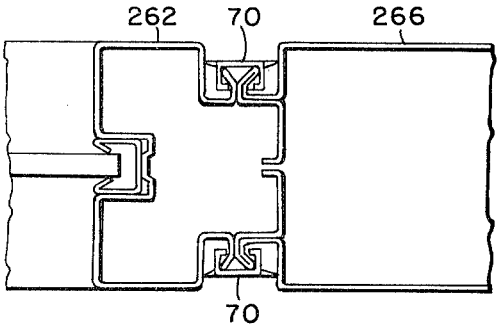
Figure 22:
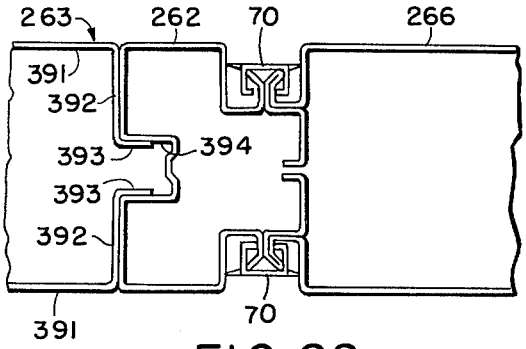
Figure 23:
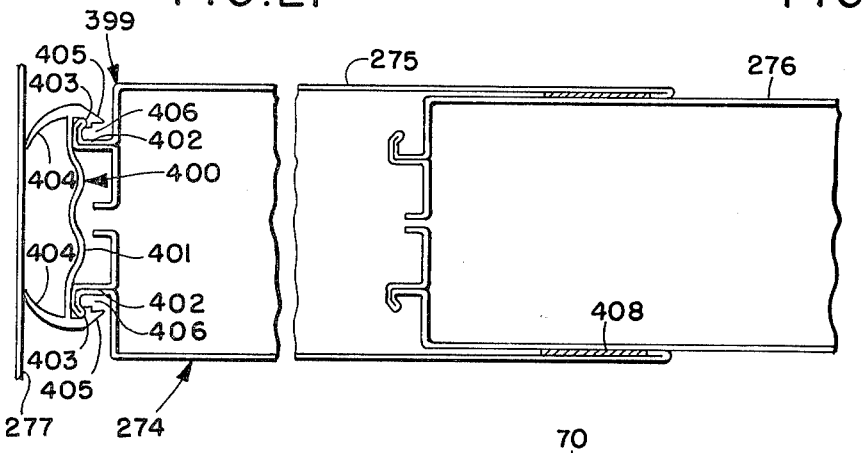
Figure 24:
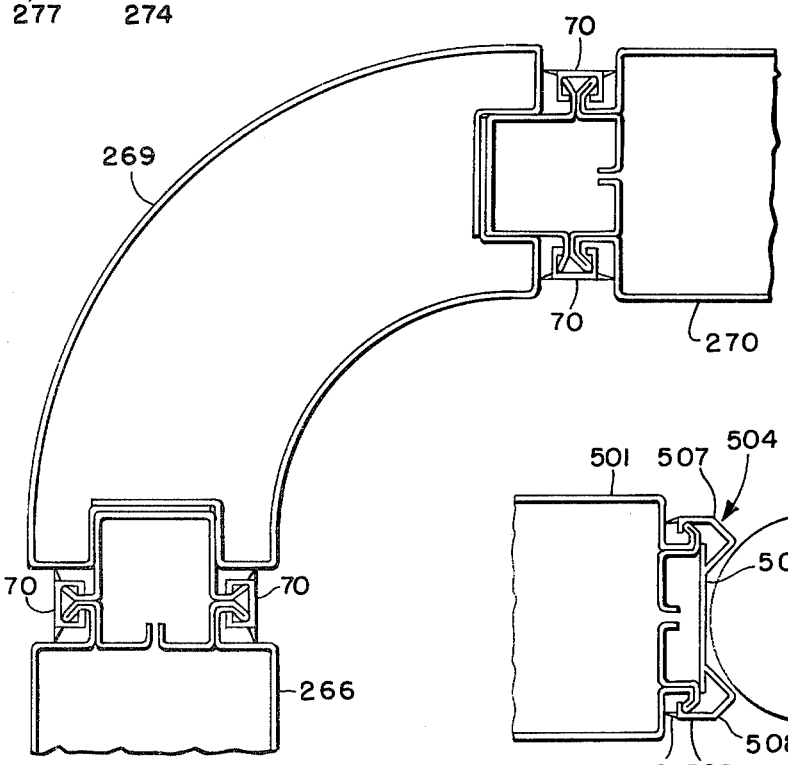
Figure 27:
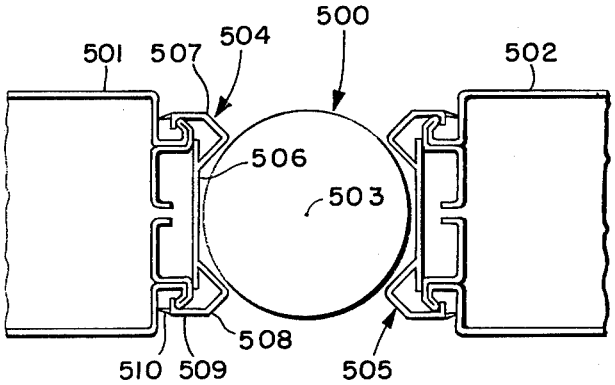
FIGS. 26–30 relates to various other exemplary intersections between the various modular components in accordance with the invention.
Figure 25:
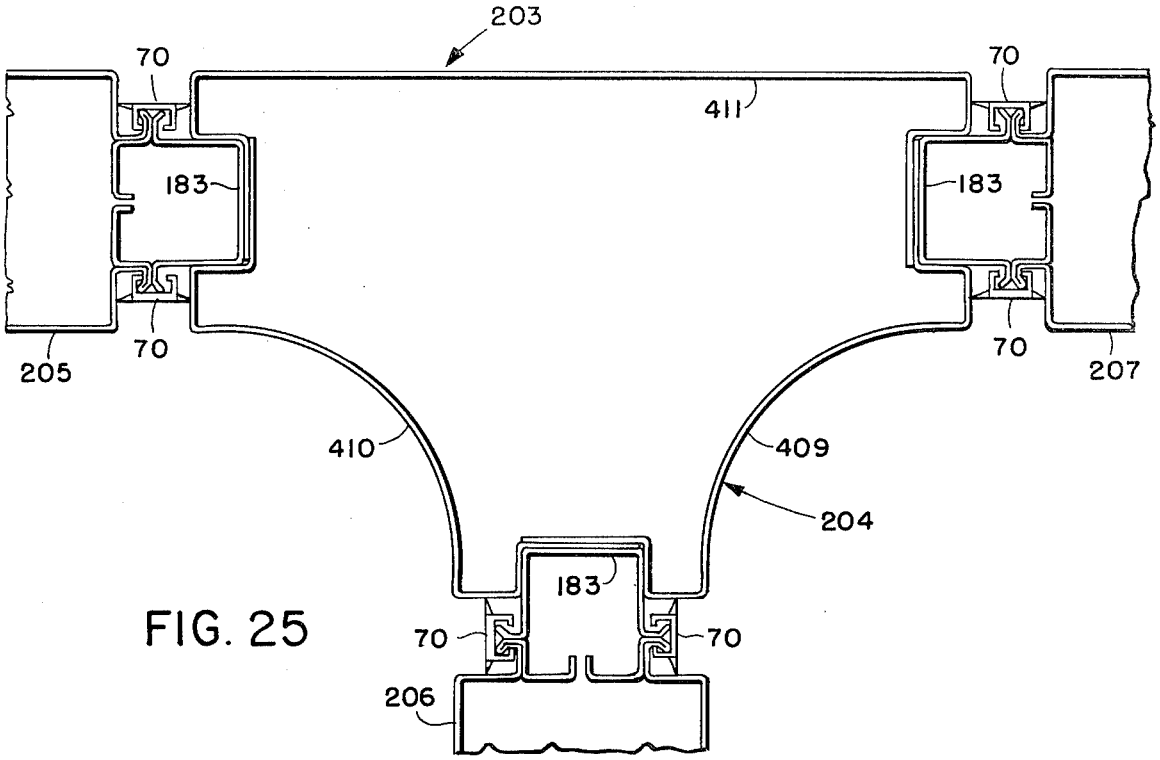
Figure 26:
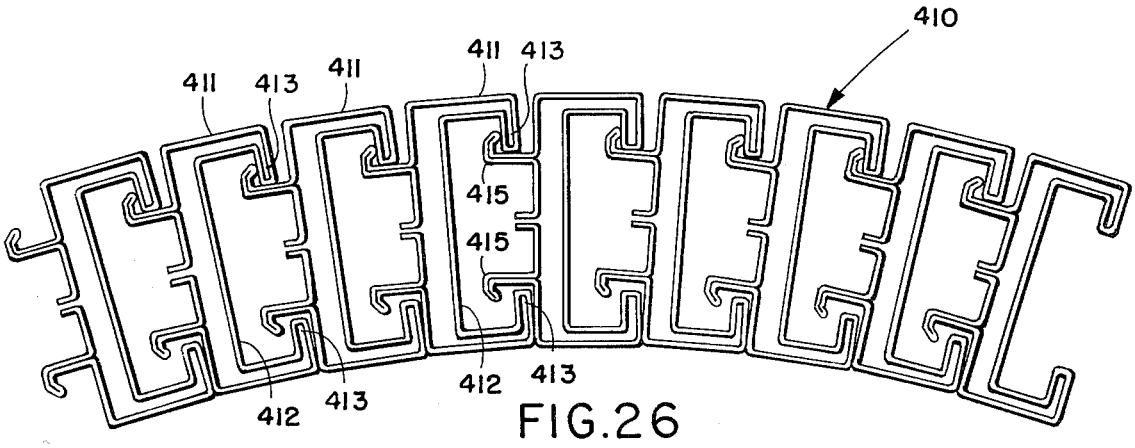
Figure 28:
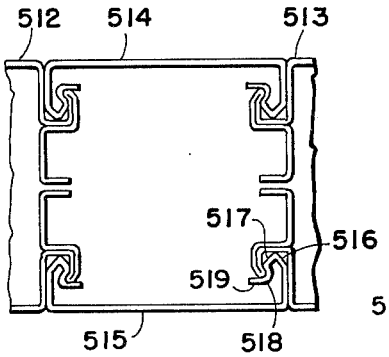
Figure 29:
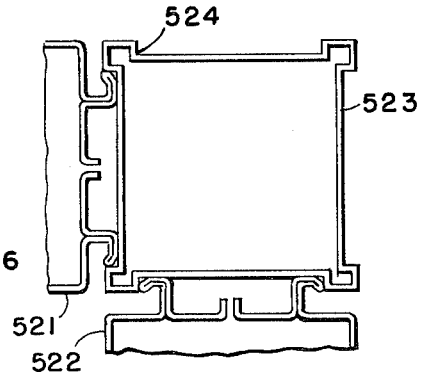
Figure 30:
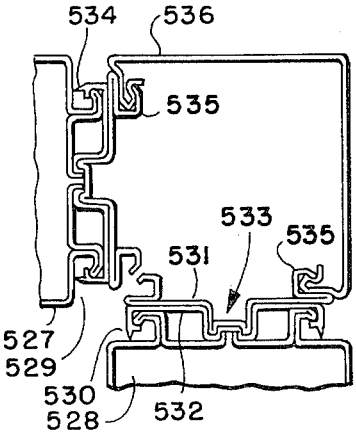

More particularly:

FIG. 1 is a plan view of a preferred panel face plate prior to its being formed in accordance with the invention;

FIG. 2 is a front elevation of the formed panel face plate constructed in accordance with the invention;

FIG. 3 is a side elevation of the face plate of FIG. 2 as seen from the plane of line 3—3 thereof;

FIG. 4 is a top view of the face plate of FIG. 2 as seen from the plane of line 4—4 thereof;

FIG. 5 is a fragmentary, broken perspective of a demountable panel construction in accordance with the invention employing two face plates of the type shown in FIGS. 2–4;

FIG. 6 is a fragmentary, broken perspective of an alternative panel construction in accordance with the invention;

FIG. 7 is a schematic section of a door panel construction utilized in the partition assembly of the invention;

FIG. 8 is a schematic section of an alternate door panel construction utilized in the partition assembly of the invention;

FIG. 9 is a schematic section of an adjustable half panel or end filler panel construction utilized in the partition assembly of the invention;

FIG. 10 is a schematic section of a two-way, curved corner panel construction utilized in the partition assembly of the invention;

FIG. 11 is a schematic section of a three-way, curved corner panel construction utilized in the partition assembly of the invention;

FIG. 12 is an enlarged fragmentary horizontal section illustrating the intersection between the mounting edges of adjacent demountable panels employing a preferred panel connector strip in accordance with the invention;

FIG. 13 is a fragmentary perspective elevation of a particular interior partition layout in accordance with the present invention employing the various modular components of the invention;

FIG. 14 is a fragmentary schematic section taken from the line 14—14 of FIG. 13 illustrating a utility panel construction in accordance with the invention;

FIG. 15 is a fragmentary schematic section taken from the line 15—15 of FIG. 13 illustrating the jamb side of an exemplary door unit assembly in accordance with the invention;

FIG. 16 is a fragmentary schematic section taken from the line 16—16 of FIG. 13 illustrating an exemplary three-way panel intersection in accordance with the invention;

FIG. 17 is a fragmentary schematic section taken from the line 17—17 of FIG. 13 illustrating an exemplary intersection between two glass panel assemblies in accordance with the invention;

FIG. 18 is a fragmentary schematic section taken from the line 18—18 of FIG. 13 illustrating the upper portion of the hinge side of an exemplary partial height door unit assembly in accordance with the invention;

FIG. 19 is a fragmentary schematic section taken from the line 19—19 of FIG. 13 illustrating the lower portion of the jamb side of another exemplary partial height door unit assembly;

FIG. 20 is a fragmentary schematic section taken along the line 20—20 of FIG. 13 illustrating the upper portion of an exemplary intersection between a door unit assembly and chair rail assembly in accordance with the invention;

FIG. 21 is a fragmentary schematic section taken along the line 21—21 of FIG. 13 illustrating the upper portion of an exemplary intersection between a chair rail assembly and solid panel in accordance with the invention;

FIG. 22 is a fragmentary schematic section taken along the line 22—22 of FIG. 13 illustrating the lower portion of the exemplary intersection of FIG. 21;

FIG. 23 is a fragmentary schematic section taken along the line 23—23 of FIG. 13 illustrating an exemplary end filler panel assembly in accordance with the invention;

FIG. 24 is a fragmentary schematic section taken along the line 24—24 of FIG. 13 illustrating an exemplary two-way curved corner panel assembly in accordance with the invention;

FIG. 25 is a fragmentary schematic section taken along the line 25—25 of FIG. 13 illustrating an exemplary three-way curved corner panel assembly in accordance with the invention;

FIG. 26 is a fragmentary schematic section of an exemplary flexible corner partition assembly in accordance with the invention;

FIG. 27 is a fragmentary schematic section of an exemplary screen partition assembly showing the intersection between adjacent panels in accordance with the invention;

FIG. 28 is a fragmentary schematic section of an exemplary wall or screen partition assembly showing a two-way construction in accordance with the invention;

FIG. 29 is a fragmentary schematic section view of an exemplary wall or screen partition assembly showing a form of corner post construction in accordance with the invention; and FIG. 30 is a schematic section of a wall or screen assembly using a corner cap.

DESCRIPTION OF THE PREFERRED EMBODIMENTS

Referring now in greater detail to the drawings, and initially to FIG. 5, there is designated generally by reference number 10 a unified, demountable panel constructed in accordance with the invention. The panel 10 is constructed from a pair of substantially parallel, spaced-apart metal face plates 11 of a preferably thin gauge sheet metal having substantially rectangular planar central portions 12 and opposite edge portions 14. The space between central portions 12 may be reinforced by a honeycomb or rib structure and/or filled with suitable fire and sound insulating material such as rock wool, foamed plastics, etc., whereby the panel may meet the various strength and fire resistance codes.

As best seen in FIGS. 2-5, each edge portion 14 of the face plates 11 is bent inwardly to define web portions 15 extending the full height of the metal plates 11. The web portions 15 extend substantially perpendicular to central portions 12. Edge portions 14 are further bend outwardly from web portions 15 and are reversely folded to define recessed, J-shaped flanges 16 having main double folded portions 18, intermediate double folded portions 19 and terminal folded portions 20. Main folded portions 18 extend outwardly from web portions 15 substantially perpendicular thereto. Intermediate folded portions 19 extend outwardly from main folded portions 18 substantially perpendicular thereto, and accordingly parallel to web portions 15. Terminal folded portions 20 extend inwardly from intermediate folded portions 19 and outwardly away from main folded portions 18, thereby being inclined back toward the web portions 15. Preferably, the terminal folded portions 20 approach but do not intersect a plane through the corners 21 of the face plates at 45° to the plane of the face plates 12. Preferably, the terminal folded portions 20 are inclined at 45° to the central portions 12 of the face plates. The terminal folded portions 20 terminate at terminal folded portion edges 22 which are spaced outwardly from web portions 15 to define recesses 23. Longitudinally-spaced slots 24 are formed through main folded portions 18 of the recessed flanges 16 and are in the backs of the recesses 23. The edge portions 18 extend further inwardly from recessed flanges 16 to form inner web portions 26 which extend substantially from web portions 15. The inner web portions 26 terminate in outwardly bent terminal connecting flanges 28 which extend substantially perpendicular to inner web portions 26.

The face plates 11 with the configuration described are reversely positioned with the central portions 12 thereof spaced apart, and with the terminal flanges 28 thereof juxtaposed or butted so as to form panel 10 with mounting panel edges 29. Abutting terminal flanges 28 are then secured together by suitable fasteners such as elongate clips 30, only one of which is shown at the right-hand side of the panel 10 of FIG. 5. The clip 30 is comprises of U-shape portions 31 which are adapted to enclose and hold together the juxtaposed terminal flanges 28. The U-shape portions 31 are maintained in spaced-apart relationship by flange portions 32 which extend outwardly substantially perpendicular from the tops of the stems 34 of the U-shape portion substantially along the length of terminal flanges 28. The stems 34 of the U-shape portions 31 are of sufficient length so that the flange portions 32 abut substantially the inner web portions 26 when properly in position. The inner edges of the flange portions 32 form slots intermediate the U-shape portion through which the butted terminating flanges 28 extend. As shown in FIG. 5, the butted terminated flanges 28 are cut as with sheet metal shears adjacent the U-shape portions 31, and the tabs 35 formed thereby are bent outwardly away from one another so as to overlap flange portions 32 of the clip 30 thereby locking the same in place. Alternatively, those portions of the butted terminal flanges 28 extending through the slots intermediate the U-shape portions 31 need only be mechanically deformed, for example as by twisting, to prevent passage of the same through the slots to maintain the clip in place. Obviously, the butted terminal flanges 28 could also be secured together by other fasteners, such as rivets, screws, other clips, or welding. Even the clips employed may be secured to the flanges by fasteners rather than by the deformed edge as illustrated.

It should be appreicated that the bending and folding of the sheet metal face plates 11, and their manner of securement together, provides opposite mounting panel edges 29 which are very strong and capable of serving as structural supporting members themselves with or without structural posts. Accordingly, such panel 10 can be used as a wall panel with or without structural posts or a screen panel with or without such posts as is customary in interior partition assemblies. This will become more evident as the discussion of the invention proceeds.

With reference to FIG. 1 which shows the sheet metal face plate 11 prior to forming, there are formed in the opposite edges 14 of the planar sheet inner and outer parallel rows of longitudinally-spaced slots, 36 and 37, respectively. The slots of the outer rows 37 are larger in size than those of the corresponding inner rows of slots 36. When bent and folded by roll forming, the larger slots of the outer rows 37 are aligned behind the smaller slots of the inner rows 36 to form the slots 24 in the recesses flanges 16. No longer is exact alignment required because the smaller slots of rows 36 need only fall in alignment with any portion of the larger slots of rows 37. Although either row of slots may have the larger slots, it is preferred for aesthetic reasons that the outer row 37 have the larger so that they are hidden behind the smaller slots of the row 36.

As should be apparent from FIG. 1, the inner web portions 26 and connecting flanges 28 need not extend the entire length of the face plate 11. The face plate 11 further may be provided with top and bottom inwardly folded flanges 38 and 39 along the upper and lower edges thereof for stiffening or to facilitate assembly with ceiling and floor channels, for example.

Referring now to FIG. 6, in another fabricating embodiment, an intregrated panel construction is designated generally by reference numeral 40. The panel 40 is constructed from a pair of substantially parallel spaced-apart light gauge sheet metal face plates 41 having substantially rectangular planar central portions 42 and opposite edge portions 44. The space between central portions 42 of face plates 41 may be filled as above described. Each edge portion 44 of face plates 41 is bent inwardly to define web portions 45 extending the full length of face plates 41. Web portions 45 extend substantially perpendicular to central portions 42. The web portions 45 terminate in connecting folded flanges 46 which extend outwardly substantially perpendicular to web portions 45.

The above described face plates 41 are reversely positioned with central portions 42 thereof spaced apart, and with connecting flanges 46 juxtaposed. Juxtaposed connecting flanges 46 are then secured together by vertical member 48 which extends substantially the height of the face plates 41.

Vertical member 48 is of heavier gauge sheet metal or may be an extrusion and has a central channel 49 which encloses connecting flanges 46 to hold them together. The vertical member 48 is bent outwardly at the edges of the central channel to define web portions 50 which extend substantially perpendicular thereto. When assembled, the web portions 50 are adjacent to and extend substantially parallel to the web portions 45 of the face plates 41. The web portions 50 of the vertical members 48 terminate at outwardly bent edge flanges 52. The edge flanges 52 form J-shape projections and include main portions 53, intermediate portions 54 and terminal portions 55. Main portions 53 of the edge flanges 52 extend outwardly substantially perpendicular to web portions 50. Intermediate portions 54 extend outwardly away from the main portions 53. Terminal portions 55 extend inwardly from intermediate portions 54, thereby being inclined back toward the web portions 45 of the face plates. The terminal portions 55 terminate at edges 58 which are spaced outwardly from the web portions to define recesses 59. Longitudinally-spaced slots 60 are formed in main portions 53 of the vertical member and are in the back of recesses 59.

It should be appreciated that bent edge portions 44 of the face plates 41 and the vertical members 48 combine to form reinforced mounting panel edges 61 which are very strong and capable of serving as structural supporting members themselves with or without metal posts commonly employed in partition screen assemblies.

It should also be appreciated that unified panel 10 and integrated panel 40 have respective outwardly extending, recessed, J-shape flanges 16 and 52 of like shape and accordingly may be used interchangeably in the overall partition system of the present invention.

While the panel of FIG. 5 is preferred, the panel of FIG. 6 may be substituted where the skill and investment for roller die tooling is not available.

CONNECTOR STRIPS—FIG. 12

Referring now to FIG. 12, the intersection of two adjacent screen or wall panels can be seen. Although the following description would apply to connections between panels of either of the above described construction (or between any of the below described modular components), only the details of the connection between panels 10 is shown for the sake of convenience. The panels 10 are positioned in in-line relationship with central portions 12 of the face plates forming the partition wall surfaces. The mounting panel edges 29 of the panels 10 are adjacent one another with the intermediate folded portions 19 of the recessed J-shape flanges 16 juxtaposed. The J-shape flanges 16 of adjacent panels then may br readily joined together by connector strips 70 preferably on both sides of the panels.

The connector strip 70 of the invention is preferably a plastic extrusion having a central U-shape body 71, the legs of which are adapted to embrace and hold together the adjacent J-shape flanges 16 of the panels along their full vertical height. The U-shape portion 71 is formed with a bight portion 73 and inwardly extending legs 74 having inturned edges 75 which extend over the terminal folded portion edges 22. The U-shape body 71 is sufficiently flexible, although relatively stiff, to allow placement of the connector strip 70. The strip is also sufficiently rigid to provide for securely holding the panels together. The connecting strip 70 readily can be attached to the J-shape flanges 16 by starting the strip at top or bottom of the panel plates and depressing the same over the flanges 16 along the length thereof in zipper-like fashion. The dimensions of the strip are such that at least two continuous seal lines are provided for the full height of the partition.

The connector strip 70 is also formed with flanges or wings 76 extending outwardly from the bight portion 73. The wings 76 span across recess 23 toward web portions 15 of the panels for overlying and concealing slots 24 in main folded portions 18. Preferably, the distal ends of the wings are spaced apart a distance greater than that between web portions 15 of the adjacent panels so that they are partially inwardly flexed. The wings 76 may readily be deformed inwardly for attaching a mounting member such as support bracket 77 for an accessory. The panels 10 may also be clad with an optional surface material 78, i.e., fabric, wood veneer, vinyl, etc. In such case, the wing is inwardly deformable to account for the decreased spacing between opposite web portions 15 of adjacent panels. Connector strips 70 also provide a decorative recessed covering which hides the vertical slots and presents a pleasing appearance. The connecting strips also provide a sound and light barrier between opposite sides of the panels.

The connecting strip 70 is preferably a plastic coextrusion with the plastic of the wings being more flexible than the plastic of the central body portion. The strip may be compounded from a variety of materials such as vinyl in any desirable color for complementing the decorative surface color provided on the metal face plates. Contrasting colors have been found to give the assembled wall partition a pleasing delineated effect.

Additional Modular Components—FIGS. 7-11

It will be appreciated that the above described panel constructions and interconnection therebetween from the basis for a family of modular components constructed in accordance with the invention. The remaining modular components which may form the family are shown in FIGS. 7-11. It will be appreciated that each modular component includes at least one mounting panel edge similar in shape to the above described mounting panel edges for interconnection thereat with adjacent structural components. From this family of modular components, any variety of floor plans can be assembled in either full or screen height systems. Of course, other modular components may exist or be developed in addition to those illustrated and described.

FIG. 7 shows a door frame 80 constructed in accordance with the invention. The door frame 80 includes substantially parallel, spaced-apart metal face plates 81 having central portions 82 and opposite edge portions 83 and 84. The edge portions 83 are formed the same as the edge portions 14 of the panel 10 and include J-shaped recessed flanges 86 and terminal flanges 87 of like construction. Accordingly, such door side panel 80 may be connected at edge portions 83 as by connector strip 70 to panel 10 or any other panel provided with a like edge construction. Opposite edge portions 84 are bent reversely and inwardly to define arms 88 having inwardly extending edge restrictions 89. The rebent portions 88 terminate in inwardly extending web portions 90 which extend substantially perpendicular to central portions 82. The web portions 90 terminate in outwardly bent connecting flanges 92 which extend substantially perpendicular to the web portions 90.

The face plates 81 of the above-described construction are reversely positioned with the central portions 82 thereof spaced-apart and parallel, and the respective terminal flanges 87 and 92 thereof juxtaposed so as to form door side frame panel 80. Juxtaposed connecting flanges 87, 92 may be secured together in the manner described in connection with panels 10. When so assembled, the arms 88 of the face plates 81 form a relatively deep channel 93 and edge portions 83 form reinforced mounting panel edges 94.

In FIG. 8, there is shown another form of door frame panel constructed in accordance with the invention which is designated generally be reference numeral 100. Door panel 100 is constructed from a pair of substantially parallel, spaced apart face plates 101 and 102. Face plate 101 has central portion 103 and opposite edge portions 104 and 105. Face plate 102 has central portion 106 and opposite edge portions 107 and 108. Edge portions 104 and 107 of the respective face plates 101 and 102 are formed in identical manner as edge portions 14 of face plates 11 of panel 10. Accordingly, edge portions 104 and 107 have respective recessed J-shaped flanges 110 and 111 and respective connecting flanges 112 and 113. The opposite edge portion 105 of face plate 101 is reversely folded to define door jamp portion 115 and then rebent back toward central portion 103 to define inturned edge restriction 116. The inturned edge restriction 116 terminates in web portion 117 which is bent inwardly and extends substantially perpendicular to central portion 103. Edge portion 108 of the other face plate 102 is similarly formed to edge portion 105, but without a reversely folded jamb portion 115. Accordingly, edge portion 108 has inturned edge restriction 118 and web portion 119.

The face plates 101 and 102 are reversely positioned with central portions 103 and 106 spaced apart and parallel. The connecting flanges 112 and 113 of the respective face plates 101 and 102 are juxtaposed and may be secured together by suitable means such as described above. The web portions 117 and 118 of the opposite edge portions 105 and 108 overlap one another and may also be secured together by any suitable means. A spacer member 120 is provided nearest the opposite edge portions 105 and 108 to ensure proper spacing of the central portions 103 and 106 thereat. The spacer member 120 includes a spacer portion 121 which extends substantially perpendicular to the central portions 103 and 106 and is of a width equal the spacing between the interior surfaces of such central portions. The spacer portion 121 terminates in flanges 122 which extend substantially perpendicular to the spacer portion 121 and abut central portions 103 and 106.

Referring now to FIG. 9, there is shown an end filler or half panel 140. The half panel 140 is constructed from a pair of sheet metal face plates 141 each having central planar portions 142, edge portions 143 and opposite edge portions 144. Edge portions 143 of face plates 141 are bent and folded in like manner as edge portions 14 of panel 10. Accordingly, there is formed recessed J-shaped flanges 146 and connecting flanges 147. Edge portions 144 of face plates 141 are reversely inwardly folded to form double thickness terminal edges 148. The face plates 141 of such configuration are reversely positioned with the central portions 142 thereof spaced apart. Juxtaposed terminal flanges 147 may be secured together by suiable fasteners, such as by clip 30 shown in FIG. 5. The double thickness terminal edges 148 may be maintained in spaced-apart relationship by a suitable core or filler.

The inner surfaces of the folded edges 148 are preferably spaced-apart by an amount substantially equal to the thickness of the panels 10. Without a core or filler, an adjustable panel may then be formed by telescopically inserting one end of a panel 10 between the face plates 141 of half panel 140. The extent of overlapping of the panel 10 with half panel 140 will determine the width of the composite panel formed thereby. Reference may be had to FIG. 23 where such an adjustable composite panel is shown and used as an end filler and which will be described in greater detail below.

Referring now to FIG. 10, there is shown a two-way curved corner panel 170 which is constructed with inner and outer curved face plates 171 and 172 which are concentrically arranged. Inner face plate 171 has curved central portion 173 and opposite edge portions 174. The edge portions 174 are bent radially outwardly yet inwardly of the panel to define web portions 175 extending the full height of the face plate 171. Edge portions 174 are further bent inwardly from web portions 175 and then again to form flanges 176 which extend parallel to web portion 175. The outer face plate 172 has curved central portion 177 and opposite edge portions 178. The edge portions 178 are bent radially inwardly from curved portion 177 to form web portions 179. Edge portions 178 are further bent inwardly and then again to define flanges 180 which extend parallel to web portions 179.

The inner and outer face plates 171 and 172 are reversely positioned with the curved central portions 173 and 177 thereof concentrically arranged, and with flanges 176 and 180 in overlapping relationship. When properly positioned, there is formed by the flanges 176 and 180 outwardly opening channels 182. The channels 182 are adapted to receive vertical elements 183 which are U-shaped. The distal arms of the U-shaped element 183 form J-shaped flanges 186 whereby such curved corner panel may be connected to adjacent panels as by connector strip 70 in the before described manner. The vertical elements are adapted to snugly fit in channel 182 with the base thereof in abutment with overlapping flanges 176 and 180. The vertical element 183 and face plates 171 and 172 may be readily secured together at the base of the channel 182 by suitable fasteners.

It should be appreciated that instead of the above-described construction of edge portions 174 and 178, such could instead be formed in the same manner as the edge portions 14 of panels 10, but additional roll tooling would be required to form the major curve of the face plates and the volume in such components may not warrant the investment in such tooling.

Moving now to FIG. 11, there is shown a three-way curved corner panel 190 which is constructed with planar face plate 191 and curved face plates 192. Planar face plate 191 is identical in construction to face plate 11 of panel 10 but is of a substantially lesser width. Accordingly, the planar face plate includes central planar portion 193 and edge portions 194, the edge portions having J-shaped flange 195 and connecting flange 196. Curved face plates 192 have curved central portions 197 and edge portions 198. Edge portions 198 are bent inwardly (radially outwardly) similar to edge portion 194 and have J-shaped flanges 199 and connecting flanges 120. The terminal flanges 196, 120 of adjacent face plates are positioned in abutting arrangement and secured to form the panel 190.

It will again be appreciated that FIGS. 10 and 11 show two different forms of the curved corner face plates, one (FIG. 11) wherein the edges are roll formed, and the other (FIG. 10) wherein the edges are not. Such face plates and the modules formed thereby may be used interchangeably in the systems of the invention.

An Exemplary System—FIGS. 13–25

Referring now to FIG. 13, there is illustrated a full height partition system constructed in accordance with the invention employing the above-described family of modular components. Such partition construction may extend from the floor 200 to a suspended ceiling 201 and comprises, reading from left to right, a three-way curved corner panel assembly 203 made up of three-way curved corner panel 204 and solid panels 205-207. In line with solid panel 207 and connected thereto is utility panel 208 which in turn is in line with and connected to solid panel 209. Solid panel 209 is in line with and connected to full-height door unit assembly 210. Full-height door unit assembly 10 comprises door frame panels 212, 213 and full height door 214. Further in line with utility panel 209 and full-height door unit assembly 210 is another solid panel 217 which forms a three-way intersection with yet another solid panel 219 and glass panel assembly 220. Glass panel assembly 220 extends in a direction normal to solid panels 217, 219, and along with in-line glass panel assemblies 221-224, forms a substantially transparent partition wall. Each glass panel assembly, such as glass panel assembly 223, comprises a pane of glass 228 extending between frame panels 229 and 230.

Moving now to the more distant partition walls of FIG. 13, there is shown a partial height door unit assembly 240 comprised of door panels 241, 242, lintel panel 243 and door 244. Door panel 241 is connected in-line to solid panel 245 while door panel 242 is connected at a three-way intersection to another solid panel 247 and chair rail assembly 248. Such chair rail assembly 248 extends normal to door panel 242 and solid panel 247 and comprises frame panels 250, 251, chair rail panel 252 and glass panel 253 mounted above chair rail panel 252 and between frame panels 250, 251. The chair rail assembly 248 is connected at frame panel 251 to another partial height door unit assembly 255 which comprises door panel 256, frame panel 257, lintel panel 258, and door 259. Continuing from left to right, the door unit assembly 255 is connected in-line to another chair rail assembly 260 which comprises frame panels 261, 262, chair rail panel 263, and glass panel 264. The frame panel 262 is connected in line with solid panel 266 which forms two-way curved panel assembly 268 along with two-way curved corner panel 269 and solid panel 270 extending normal to solid panel 266. Finally, there is shown an end filler panel assembly 274 comprised of half-panel 275 and solid panel 276 which abut against solid panel 277 in a direction normal thereto.

Now referring to the manner in which the various components may be secured together, reference may be had to FIGS. 14–25. Referring first to FIG. 14, it may be seen that utility panel 208 may be secured at its mounting edges 280 to respective mounting edges 282 and 283 of solid panels 207, 209 as by connector strips 70 in the above described manner. The utility panel 208 is essentially a hybrid of above-described panel 10 and comprises a pair of face plates 286 and 287. Face plate 286 is of identical construction as the face plates 11 of panel 10. Face plate 287, however, has formed in its central portion 289 intermediate its rolled edge portions 290 a U-shaped channel 292 which may house, for example, electrical conduit and the like. The channel 292 includes sides 293 which extend substantially perpendicular to the faces 294 of the central portion 289 and base 295 which extends parallel to such faces. As shown, the base 295 may be substantially in abutment with planar central portion 298 of face plate 286. After necessary utility connections are made, a cover plate 299 may be secured to the face plate 287 to conceal the channel 292 as well as its contents. Such cover plate 299 includes planar face portion 300 which extends substantially the full width of the face plate 287. The edges of the face plate 300 are reversely folded and then bent inwardly to form flanges 302 which interfit within the channel 292. The flanges 302 are bent at their ends to form terminal flanges 304, which extend parallel to and adjacent the base 295 of the channel 292. The cover plate 299 thereby may be readily secured to the face plate 287 by a suitable adhesive or magnetic tape 306 applied to the terminal flanges and brought into contact with the base 295 of the channel 292. With reference to FIG. 13, the cover plate 299 may be provided with suitable openings for electrical wall sockets 308 or the like.

In FIG. 15, there is shown the jamb side of door unit assembly 210. Connector strips 70 are again employed to secure door frame panel 212 to solid panel 209 at their respective mounting edges 321 and 322 in the above described manner. Affixed at the other edge 323 of door panel 213 is a vertically extending door jamb 324 of the configuration shown which comprises body portion 325 and door stop portion 326. Body portion 325 includes inwardly directed spring leg portions 326 and 327 that snap over the inturned edge restrictions 328 of the door frame panel to secure the door jamb 324 to the door frame panel. The door stop portion 326 may have attached inside its folded distal end a resilient bumper and door seal 327 against which the door 215 closes.

FIG. 16 shows an exemplary three-way intersection between solid panels 217 and 219 and frame panel 233 of glass panel assembly 220. Solid panels 217 and 219 are secured at their respective mounting edges 330 and 331 by connector strips 70. To provide a mounting edge to which frame panel 233 can be secured, a vertically extending channel-shape element 334 is secured to a recessed flange of one of the panel mounting edges such as recessed flange 335 of mounting edge 330 by bracket or key 336. Key 336 may have suitable hook tabs 550 which engage in aligned slots provided in recessed flange 335 and channel-shape element 334. Preferably, several such keys 336 are vertically spaced along the length of the panels rigidly to secure the channel 334 thereto. The channel 334 has a main body portion 337 which spans the gap 338 between adjacent panels 217 and 219. The vertical edges of the main body portion 337 are bent outwardly away from the faces of panels 217 and 219 to define J-shaped edge flanges 339. The J-shaped flanges 340 of frame panel 233 are secured to J-shaped flanges 339 by connector strips 70. As shown, glass pane 232 may be secured along its vertical edge in central channel 342 of glazing frame panel 233 by glazing strip 343.

FIG. 17 shows an exemplary two-way in-line intersection between adjacent glass panel assemblies 222 and 223. The frame panel 229 comprises two frame panels 233 which are reversely positioned and secured together at their mounting edges 350 by connector strips 70. The glass panes 232 of the glass panel assemblies 222 and 223 may be secured in the frame panel central channels 352 by glazing strips 353.

Turning now to FIG. 18, there is shown the upper portion of an exemplary intersection between chair rail panel assembly 252 and partial height door unit 255. Door frame panel 256 and frame panel 251 are secured together at their respective mounting edges 360 and 361 by connector strips 70. Lintel panel 258 is of a construction similar to the solid panels such as shown in FIG. 5 but has a height sufficient to fill the space between door 259 and ceiling 201. The lintel panel 258 may be interconnected to door panel 256 by fitting the recessed flanges 363 behind channel edge restrictions 364 of the panel 256. This may conveniently be done by endwise inserting the recessed flanges 363 behind the edge restrictions 364 at one end of the door panel 256 and slidably moving such panels relative to each other into their proper relationship prior to assembly of the same into the partition wall.

FIG. 19 shows the jamp side of partial height door unit 240 which employs door frame panel 241 of like construction as the door panel 100 shown in FIG. 8. Door panel 241 is secured to solid panel 245 at the respective mounting edges 370 and 371 by connecting strips 70. At the other edge 373 of door panel 241 is door jamp 374 of the configuration shown. Affixed to the door jamb portion 375 of door panel 241 is a bumper and door seal 376 against which the door 244 closes. The dove-tail channel of the door frame includes a snap-in insert or filler 377 so that the frame has a recessed edge 378 in the plane of the door 244 when closed.

FIG. 20 shows the intersection of door frame 251 to glazing frame panel 261 of chair rail assembly 260. Such panels are fastened together at their adjacent mounting edges by connector strips 70. The bottom of the glass panel is supported by a glazing frame 387, which is the same as frame 251, which also then becomes the chair rail.

FIG. 21 shows the intersection between frame panel 262 and solid panel 266. The same may be fastened together at their adjacent mounting edges again by connector strips 70. It is noted that FIG. 21 is simply the reverse of FIG. 20.

FIG. 22 shows the lower portion of the intersection between chair rail assembly 260 and solid panel 266. The frame panel 262 is secured to solid panel 266 at the adjacent mounting edges by connector strips 70. The chair rail panel 263 comprises face plates 391 having inturned edge portions 392 which terminate in outwardly bent terminal flanges 393 adapted to interfit within central channel 394 of the frame panel 262.

FIG. 23 shows the end filler assembly 274. Solid panel 276 is telescoped within the open end of half panel 275 and adjusted so that the mounting edge 399 of half panel 275 is adjacent solid panel 277. An elastomeric gasket 400 is positioned between mounting edge 399 and solid panel 277. Gasket 400 preferably extends the full length of mounting edge and includes central portion 401 spanning the J-shaped flanges 402. Gasket 400 has inclined flange portions 403 overlying the flanges 402 and flexible wings 404 extending oppositely the flange portions 403 into sealing engagement with solid panel 277. There may also be provided wing portions 405 on flange portions 403 which substantially span across mounting spaces 405 of half panel 275 to conceal slots in the J-shape flanges 402. Once the half panel face plates are in place, they may be secured to the exterior of the solid panel 276 by the double sided adhesive tape shown at 408.

FIG. 24 shows the two-way curved panel 269 secured to adjacent solid panels 266 and 270 at their respective mounting edges again by connector strips 70. The two-way curved panel 269 is the same as the panel 170 of FIG. 10.

FIG. 25 shows the three-way curved panel assembly 203. Instead of a three-way curved panel of the type shown in FIG. 11, there is shown a three-way curved panel 205 of like shape but constructed with non-roll formed curved face plates 409 and 410 and planar face plate 411. The mounting edges formed by the face plates are similar in construction to those of the two-way curved panel of FIG. 11. Such mounting edges may be fastened by connector strips 70 to the adjacent mounting edges of panels 205-207.

Referring now to FIG. 26, there is illustrated a flexible corner or curved partition assembly designated generally by reference numeral 410. Flexible partition assembly 410 comprises a series of relatively narrow vertical elements 411 interfitting to form the partition. Each element 411 includes at one end a relatively deep female channel 412 having inturned edge restrictions 413. The opposite ends of each element 411 include outturned J-shape edge flanges 415 adapted to fit behind the corresponding edge restriction 413 of the channel 412 of the adjacent element with sufficient clearance so that each element may be positioned at a slight angle with respect to the adjacent element. The arcuate extent of the flexible corner or curved partition may be governed by the extent of the J-shape flange or the extent of the female channel in which it is received.

Screens—FIG. 27

Screens generally do not go full height floor to ceiling. Such screens may vary in height from relatively low screens to screens which almost extend to the ceiling. Such screens are generally supported on posts extending from the floor. Such screens are also generally more narrow than conventional full height partitions although they need not be. Moreover, many screens in office layouts today support accessories such as work surfaces, storage units, or filing cabinets, shelves and the like. Therefore, sturdy panels are often required in screens and there is no reason why screen partition panels cannot be of the same construction as full height partition panels.

One of the most commonly employed forms of posts for screens is shown in FIG. 27. The post 500 is circular and permits the panels connected thereto such as seen at 501 and 502 to be pivoted about the vertical axis 503 of such post. Conventionally, the panels are supported on the post by hooks, top and bottom. It will be noted that the panels 501 and 502 are identical to the monoconstruction panel seen in FIG. 5.

In order to provide an appearance cover between the panels and posts, each panel is provided with a vertically extending plastic gasket as seen at 504 and 505. Each gasket comprises a vertically extending planar base portion 506 seating against the exterior of the J-shape flanges of the panel. Extending therefrom are two legs 507 and 508 symmetrically arranged which project initially toward the post at approximately 45°. The legs then extend radially of the post and terminate in L-shape legs 509, the short leg of which snaps behind the edge 22 of the J-shape flange. Continuing from the long leg of the L is a feathered more flexible edge 510 which functions to conceal and yet provide access to the slotted recess of the panel. Again, the gasket may be a coextrusion to obtain the different required characteristics in different areas. In any event, precisely the same panel is employed as in the full height partitions.

Screen or Highwall—FIGS. 28–30

With reference to FIG. 28, some screens or partitions have panels 512 and 513 seen in FIG. 28 and are spaced and interconnected by vertically extending spring metal panel connectors seen at 514 and 515. Each panel connector has a spring leg which extends inwardly as seen at 516 and is bent to extend outwardly, such outwardly extending portion seen at 517 including a reentrant portion 518 terminating in stop flange 519 which extends parallel to the face of the panel connector. Such panel connectors or post caps are generally conventional and widely used in existing partition systems. They may be snapped in or out to provide access to the space indicated at 520 between the panels. In FIG. 28 the panels are spaced yet held together solely by the post caps. Accordingly, the universal panel of the present invention lends itself to use with old or conventional partition components.

As seen in FIG. 29, the same panels seen at 521 and 522 may be employed with post 523. Such post has a recessed relatively shallow channel 524 in each of the four faces thereof which accommodate the extending J-shape flanges as shown. In the manner indicated, the post acts as a key slot for the panels. The post nonetheless provides access to the slotted recesses for the hanging of accessories.

In FIG. 30, there is illustrated again the same partitions 527 and 528 interconnected in a two-way construction such that the interior slotted recesses are available for modular hanging capabiity as indicated at 529 and 530. To accomplish this each end of the respective panels is provided with a metal clip 531 fitting over a gasket 532, both being folded in the U-shape manner shown at 533 to clinch the flanged interior edges of the panel face plates. The gasket may be a coextrusion and includes the feathered edges seen at 534 concealing yet providing access to the recesses. The clip 531 in effect repeats the J-shape flange configuration as seen at 535 so that a corner cap or connector 536 may be secured as shown. Again the connector, as in FIG. 28, is provided with spring legs which cooperate with the repeated J-shape flanges of the clip releasably to secure the corner cap in place.

It will be appreciated that the illustrations seen in FIGS. 27–30 are exemplary only and that in each situation, one-, two-, three- or four-way connections may be employed.

It can now be seen that the present invention provides a unified product or partition system modules whereby high volume can be achieved so that the components can readily be roll formed. It will be appreciated that where the components are not roll formed, they may be should volume considerations warrant. In any event, whether roll formed or formed otherwise, the relatively few modular components fit together in an almost endless variety of high or low screens or full height partitions. Moreover, the components may all have modular hanging capability for accessories and are readily compatible with existing partition systems.

Other modes of applying the principles of the invention may be employed, change being made as regards the details described, provided the features stated in any of the following claims or the equivalent of such be employed.

The embodiments of the invention in which an exclusive property or privilege is claimed are defined as follows:

1. A demountable interior panel construction comprising interconnected panels, each panel including metal face plates, inwardly extending vertical edges, and recessed flanges projecting from said inwardly extending vertical edges and terminating in an outwardly extending recessed vertical connecting edge, said recessed vertical connecting edges of adjacent panels being juxtaposed, and a vertically extending plastic strip embracing said juxtaposed connecting edges holding adjacent panels together in flange-to-flange vertical edge contact, said vertically extending plastic strip including a central U-shape body portion adapted to embrace and hold together the juxtaposed connecting edges, and the legs of said central body portion being laterally spaced from adjacent inwardly extending vertical edges of said panels so that access may be had to said recessed flanges.

2. A construction as set forth in claim 1 wherein said outwardly extending vertical connecting edges have terminal inclined flanges and the legs of said central body portion of said plastic strip include inturned edge restrictions overlying said terminal inclined flanges.

3. A construction as set forth in claim 1 wherein said inwardly extending vertical edges are formed by bending inwardly the vertical face plate edges.

4. A construction as set forth in claim 1 wherein the vertical face plate edges are bent inwardly to form said inwardly extending vertical edges and then bent to form said recessed flanges.

5. A construction as set forth in claim 1 wherein said recessed flanges are formed as edge flanges on a vertical element received between said metal face plates.

6. A construction as set forth in claim 5 wherein said vertical element includes a central U-shaped channel, the legs of which form said recessed flanges.

7. A construction as set forth in claim 6 wherein said legs are J-shape.

8. A construction as set forth in claim 1 wherein said J-shape projections are formed as edge flanges on a vertical element employed to secure said face plates together.

9. A construction as set forth in claim 8 wherein the face plate edges are bent inwardly to form said inwardly extending vertical edges and then bent to form outturned flanges, and said vertical element includes a central channel enclosing juxtaposed outturned flanges of said face plates.

10. A construction as set forth in claim 9 wherein the stem of each J-shape projection is provided with a vertical row of slots.

11. A construction as set forth in claim 1 wherein said plastic strip includes at least one flexible wing extending laterally of the legs of said central body portion.

12. A construction as set forth in claim 11 including two such wings, said wings extending from the bight portion of the U of said central body portion.

13. A construction as set forth in claim 12 wherein said flexible wings abut at their distal ends the inwardly extending vertical edges of said panels.

14. A construction as set forth in claim 12 wherein said strip is a plastic co-extrusion, the plastic of said wings being more flexible than the plastic of said central body portion.

15. A demountable panel construction comprising metal face plates bent inwardly at its vertical edges to form a web portion, then outwardly from said web portion and upon itself to form a double thickness vertically extending recessed flange, and then again inwardly and then outwardly to form a second flange parallel to but offset from the face of the plate, said second flanges of opposite face plates being butted to define a width of the panel.

16. A construction as set forth in claim 15 wherein said recessed flange includes vertically spaced mounting slots.

17. A construction as set forth in claim 16 wherein said recessed flange includes inner and outer flange portions making up said double thickness flange, and said inner and outer flange portions include aligned rows of vertically spaced mounting slots.

18. A construction as set forth in claim 17 wherein the slots of one of said aligned rows are larger than the slots of the other row.

19. A construction as set forth in claim 15 further comprising fastening means for securing together the butted second flanges.

20. An elongated connecting strip for adjacent elements of an interior partition system comprising a relatively rigid central U-shape body portion adapted to embrace and hold together adjacent edges of such elements and at least one relatively flexible wing extending laterally of the legs of the central body portion.

21. A strip as set forth in claim 20 including two such wings, said wings extending from the bight portion of the U of the central body portion.

22. A strip as set forth in claim 21 wherein said strip is a plastic co-extrusion, the plastic of the wings being more flexible than the plastic of the central body portion.

23. A strip as set forth in claim 21 wherein said central body portion is relatively thicker, and therefore more rigid, than said wings.

24. A strip as set forth in claim 21 wherein said wings are tapered with their thicker end nearest said central body portion.

25. A strip as set forth in claim 19 wherein said central body portion is flexible.

26. A strip as set forth in claim 20 wherein the legs of the central body portion have inturned ends.

27. A universal panel, for a partition system, adapted to be positioned in in-line relationship with an adjacent panel to form a partition wall or at right angles to the adjacent panel to form a partition corner, said panel comprising opposite face plates each forming a face and each having an inturned vertical edge, and recessed J-shape projections by which adjacent panels are interconnected extending from each inturned vertical edge, the stem of the J extending perpendicularly to said inturned vertical edge and the curved end extending outwardly and toward the corner formed between said face and said inturned vertical edge, said projection not intersecting a plane through said corner at 45° to the plane of said face but approaching such plane at its curved end, whereby adjacent panels can be positioned in in-line relationship with the recessed flanges juxtaposed to form a partition wall or at right angles to each other with adjacent panel corners thereof butted together to form a partition corner.

28. A panel as set forth in claim 27 wherein said J-shaped projections are formed as edge flanges on a vertical element employed to secure said face plates together.

29. A panel as set forth in claim 28 wherein said inturned vertical dge terminates in an outturned flange, parallel to the face, by which the opposite face plates are interconnected, and said vertical element includes a central channel enclosing said outturned flanges.

30. A panel as set forth in claim 29 wherein the stem of each J-shape projection is provided with a vertical row of slots.

31. A panel as set forth in claim 27 wherein said J-shape projections are formed from a double thickness of said inturned vertical edge flanges.

32. A panel as set forth in claim 27 wherein the stem of each J-shape projection is provided with a vertical row of slots.

33. A panel as set forth in claim 27 wherein said inturned vertical edge terminates in an outturned flange, parallel to the face, by which the opposite face plates are interconnected, and the stem of the J projects from each vertical edge approximately equal distance said face and said outturned flange.

34. A demountable panel construction comprising laterally spaced apart panels, there being formed a gap between the vertical edges of said panels, each panel including face plates each having a face and an inturned vertical edge, and recessed J-shape flanges by which adjacent panels are interconnected, the stem of the J extending perpendicularly to said inturned vertical edge and the curved end extending outwardly and toward the corner formed between said face and inturned vertical edge to form an outwardly extending vertical connecting edge, said vertical connecting edges of adjacent panels being laterally spaced apart, and a vertically extending spring strip spanning said gap between said panels and interconnecting said laterally spaced apart connecting edges of adjacent panels to hold the same together, said spring strip including spring legs which snap between said web portion and flange of each face plate.

35. A demountable panel construction comprising metal face plates bent inwardly at their vertical edges and then upon themselves to form double thickness vertically extending recessed flanges, the inwardly-bent portions then terminating in second flanges parallel to but offset from the faces of the plates, said recessed flanges including vertically spaced mounting slots, said second flanges of opposite face plates being juxtaposed, and fastening means for securing together the juxtaposed second flanges, said fastening means comprising a vertically extending clip embracing said juxtaposed second flanges, said clip including a central U-shape channel which receives and holds together said juxtaposed second flanges.

36. A demountable panel construction comprising metal face plates bent inwardly at their vertical edges and then upon themselves to form double thickness vertically extending recessed flanges, the inwardly-bent portions then terminating in second flanges parallel to but offset from the faces of the plates, said recessed flanges including vertically spaced mounting slots, said second flanges of opposite face plates being juxtaposed, and fastening means for securing together the juxtaposed second flanges, said fastening means comprising a vertically extending clip embracing said juxtaposed second flanges, said clip including a plurality of U-shape channel portions alternating with a plurality of slots intermediate said channel portions through which said juxtaposed second flanges project, the portions of said second flanges projecting through said slots being mechanically deformed to a width greater than that of said slots intermediate said channel portions to secure said clip to said vertical edges of said panels.

37. A demountable interior panel construction comprising interconnected panels, each panel including metal face plates bent inwardly at its vertical edges and then bent to form a flange terminating in an outwardly extending recessed vertical connectng edge, said recessed vertical connecting edges of adjacent panels being juxtaposed, and a vertically extending plastic strip embracing said juxtaposed connecting edges holding adjacent panels together in flange-to-flange vertical edge contact, said vertically extending plastic strip including a central U-shape body portion adapted to embrace and hold together the juxtaposed connecting edges and at least one flexible wing extending laterally of the legs of said central body portion.

38. A construction as set forth in claim 55 including two such wings, said wings extending from the bight portion of the U of the central body portion.

39. A construction as set forth in claim 38 wherein said flexible wings abut at their distal ends the inwardly bent vertical edges of said panels.

40. A construction as set forth in claim 39 wherein said face plates are covered with a material partially overlapping the inwardly bent vertical edges and said wings are flexed to accommodate the corresponding reduction in distance between said inwardly bent vertical edges of said interconnected panels.

41. A construction as set forth in claim 38 wherein said strip is a plastic co-extrusion, the plastic of the wings being more flexible than the plastic of the central body portion.

42. A construction as set forth in claim 38 wherein said central body portion is relatively thicker than said wings and therefore more rigid.

43. A demountable panel construction comprising metal face plates bent inwardly at its vertical edges and then upon itself to form a double thickness vertically extending recessed flange, the inwardly bent portion then terminating in a second flange parallel to but offset from the face of the plate, said recessed flange including vertically spaced mounting slots, said second flanges of opposite face plates being juxtaposed, and fastening means for securing together the juxtaposed second flanges, said fastening means including a vertically extending clip embracing said juxtaposed second flanges.

* * * * *

UNITED STATES PATENT AND TRADEMARK OFFICE

CERTIFICATE OF CORRECTION

PATENT NO. : 4,251,968
DATED : February 24, 1981
INVENTOR(S) : Raith, et al.

It is certified that error appears in the above-indentified patent and that said Letters Patent is hereby corrected as shown below:

Col. 19, line 21, delete "web portion" and insert --inturned vertical edge--.

Signed and Sealed this

Eighth Day of October, 1996

Bruce Lehman

*Attest:*

BRUCE LEHMAN

*Attesting Officer*

*Commissioner of Patents and Trademarks*